US008584909B2

(12) United States Patent
Totten et al.

(10) Patent No.: US 8,584,909 B2
(45) Date of Patent: Nov. 19, 2013

(54) DISPENSING TAP FOR BEVERAGES

(75) Inventors: Kevin Totten, South Elgin, IL (US); Charlotte Hoffer Canning, Geneva, IL (US); Charles Webster, Sugar Grove, IL (US)

(73) Assignee: Hoffer Plastics Corporation, South Elgin, IL (US)

( * ) Notice: Subject to any disclaimer, the term of this patent is extended or adjusted under 35 U.S.C. 154(b) by 369 days.

(21) Appl. No.: 12/806,580

(22) Filed: Aug. 16, 2010

(65) Prior Publication Data

US 2011/0042420 A1 Feb. 24, 2011

Related U.S. Application Data

(60) Provisional application No. 61/274,593, filed on Aug. 19, 2009.

(51) Int. Cl.
*B67D 3/00* (2006.01)

(52) U.S. Cl.
USPC ..... 222/509; 222/518; 222/559

(58) Field of Classification Search
USPC ..... 222/509, 518, 511, 559; 251/339
See application file for complete search history.

(56) References Cited

U.S. PATENT DOCUMENTS

| | | | | |
|---|---|---|---|---|
| 3,263,875 | A * | 8/1966 | Lofdahl | 222/518 |
| 4,687,123 | A * | 8/1987 | Hyde | 222/518 |
| 4,848,600 | A * | 7/1989 | Dark | 222/498 |
| 5,299,718 | A * | 4/1994 | Shwery | 222/518 |
| 7,140,520 | B1 * | 11/2006 | Rutler | 222/511 |
| 2007/0181615 | A1 * | 8/2007 | Allanson et al. | 222/518 |

* cited by examiner

*Primary Examiner* — Kevin P Shaver
*Assistant Examiner* — Daniel R Shearer
(74) *Attorney, Agent, or Firm* — Knechtel, Demeur & Samlan

(57) ABSTRACT

A dispensing tap for beverages that comprises an actuator and a valve housing. A conical spring washer is joined and/or sealed to an actuator base to form the actuator. The actuator is then inserted into the valve housing to form the dispensing tap for attachment to a container containing a liquid. In use, a force is exerted on the conical spring washer to actuate the actuator base within the valve housing and thereby create an opening and/or passageway in the dispensing tap. Once opened and as the force is maintained, the liquid in the container can flow through the opening or passageway for dispensing the liquid out the dispensing tap. Upon releasing the force, the conical spring washer returns back to its original position. This movement of the conical spring washer causes the actuator base to move in the reverse direction within the valve housing thereby closing the opening and/or eliminating the passageway in the dispensing tap. The resultant seal of the actuator base to the valve housing prevents any further liquid from being dispensed from the container.

12 Claims, 2 Drawing Sheets

DISPENSING TAP FOR BEVERAGES

I. CROSS-REFERENCE TO RELATED APPLICATION

This patent application is a non-provisional application claiming priority from U.S. Provisional Patent Application Ser. No. 61/274,593, entitled "Dispensing Tap For Beverages," filed on Aug. 19, 2009, and is fully incorporated herein by reference.

II. FIELD OF THE INVENTION

The present invention relates to a dispensing tap for liquids contained in "Bag-In-Box" applications. The tap is presently intended for boxed wine applications. Similarly, all liquids that are dispensed from containers can utilize this invention.

III. DESCRIPTION OF THE PRIOR ART

This invention addresses the problem of how to manufacture a compact tap, with fewer parts than the prior art taps, which is easy to assemble. Existing taps have more parts and require a more complicated assembly procedure.

Applicant's invention comprises building a dispensing valve with only two parts, namely an actuator and a valve housing. This is accomplished by combining an actuator base, a conical spring washer, and two seals between them to form the actuator. This actuator is then situated inside the valve housing.

Advantages of this design are that it: (i) replaces multiple moving parts; (ii) plastic springs are not very common because of the limitations caused by creep in a plastic spring; (iii) the two material spring design has better functioning characteristics because of the selection of the two materials that work in combination with each other; and (iv) the inventive dispensing tap will be able to be molded and assembled at a cost savings over existing taps.

Thus, there is a need and there has never been disclosed Applicant's unique dispensing tap for beverages.

IV. SUMMARY OF THE INVENTION

The present invention is a dispensing tap for beverages that comprises an actuator and a valve housing. A conical spring washer is joined and/or sealed to an actuator base to form the actuator. The actuator is then inserted into the valve housing to form the dispensing tap for attachment to a container containing a liquid. In use, a force is exerted on the conical spring washer to actuate the actuator base within the valve housing and thereby create an opening and/or passageway in the dispensing tap. Once opened and as the force is maintained, the liquid in the container can flow through the opening or passageway for dispensing the liquid out the dispensing tap. Upon releasing the force, the conical spring washer returns back to its original position. This movement of the conical spring washer causes the actuator base to move in the reverse direction within the valve housing thereby closing the opening and/or eliminating the passageway in the dispensing tap. The resultant seal of the actuator base to the valve housing prevents any further liquid from being dispensed from the container.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
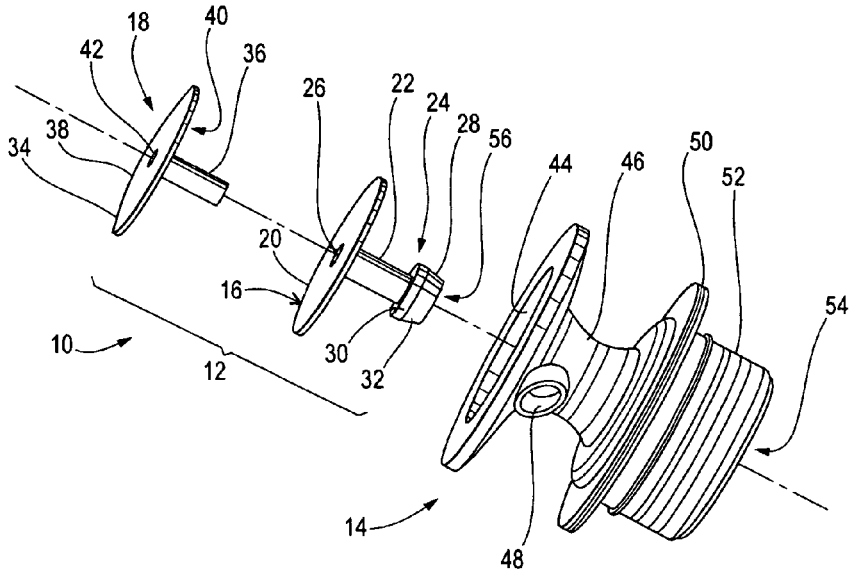
FIG. 1 is an exploded perspective view of Applicant's dispensing tap for beverages.

Turning first to FIG. 1, there is illustrated Applicant's unique dispensing tap 10. The dispensing tap 10 comprises an actuator 12 and a valve housing 14. The actuator 12 is comprised of two parts: an actuator base 16 and a conical spring washer 18.

The actuator base 16 has a top 20, a hollow actuator shaft 22, and a head 24. Preferably, the top 20 is substantially circular in shape. The actuator shaft 22 extends outwardly and substantially perpendicular from the top 20. Situated in the center of the top 20 is an opening 26 which is in alignment with the hollow actuator shaft 22. In the preferred embodiment, the opening 26 has a diameter that is substantially equal to the diameter of the hollow actuator shaft 22. The head 24 provides a closed end to the hollow actuator shaft 22. In the preferred embodiment, the head 24 also has an exterior sidewall 28 having an outward tapered surface 30 and an inward tapered surface 32 and a recess 56 contained within the exterior sidewall 28 (see also FIG. 3). In the preferred embodiment, the actuator base 16 is made of a thermo plastic elastomer or any other suitable material known to one skilled in the art.

The conical spring washer 18 has a top 34 and a hollow positioning post 36. Preferably, the top 34 has a top side 38 and an under side 40. In the preferred embodiment, the top 34 is circular in shape with the under side 40 of the top 34 being formed into a concave shape (see also FIG. 3). The hollow positioning post 36 extends outwardly and substantially perpendicular from the under side 40 of the top 34. Situated in the center of the top 34 is an opening 42 which is in alignment with the hollow positioning post 36. In the preferred embodiment, the opening 42 has a diameter that is substantially equal to the diameter of an inner bore 37 in the positioning post 36. In the preferred embodiment, the conical spring washer 18 is made from a polycarbonate material or other suitable material suitable known to one skilled in the art.

Figure 5:
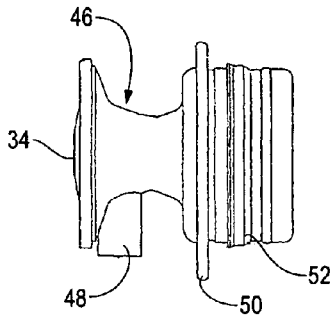
FIG. 5 is a side view of the valve housing of Applicant's dispensing tap for beverages.
Figure 4:
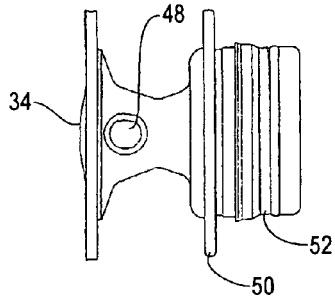
FIG. 4 is a bottom view of the valve housing of Applicant's dispensing tap for beverages.
Figure 6:
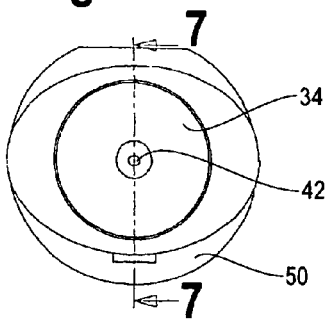
FIG. 6 is a front view of the assembled actuator and valve housing of Applicant's dispensing tap for beverages.

The valve housing 14 has a valve open top 44, a neck 46, a spout 48 extending outwardly from the neck 46, a collar 50, a circular ring 52, and a valve open bottom 54. In the preferred embodiment, the valve housing 14 is hollow throughout from the valve open top 44 to the valve open bottom 54. The valve housing 14 is also more clearly illustrated in FIGS. 4-6. Applicant further contemplates that the spout 48 can be provided with a seal or other suitable covering to keep the spout 48 clean during shipment and/or prior to being used in the dispensing tap 10, as discussed below.

Figure 2:
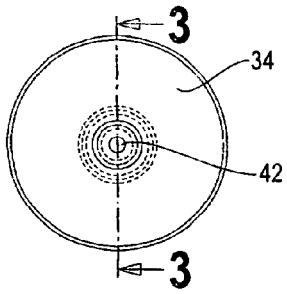
FIG. 2 is a front view of the actuator.
Figure 3:
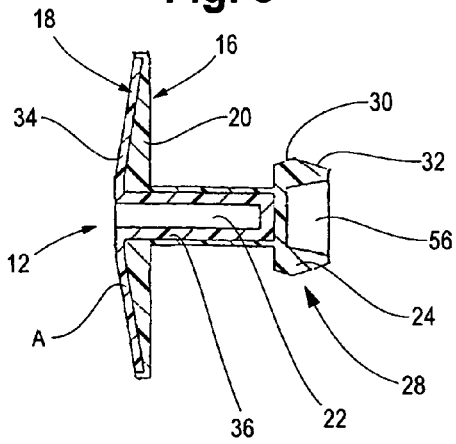
FIG. 3 is a side cross-sectional view, taken along line 3-3 of FIG. 2, of the actuator of Applicant's dispensing tap for beverages.

FIGS. 2 and 3 illustrate the assembly of the actuator base 16 to the conical spring washer 18 to form the actuator 12. In the preferred embodiment, the conical spring washer 18 is inserted into and/or received by the actuator base 16. In this manner, the positioning post 36 of the conical spring washer 18 is inserted through the opening 26 of the top 20 of the actuator base 16 and into the actuator shaft 22 until the under side 40 of the top 34 of the conical spring washer 18 engages the top 20 of the actuator base 16. In the preferred embodiment, the under side 40 of the top 34 of the conical spring washer 18 is bonded to the top 20 of the actuator base 16 to form a tight seal (i.e., seal A) between them. When assembled, these two components form one part (i.e., the actuator 12).

Figure 7:
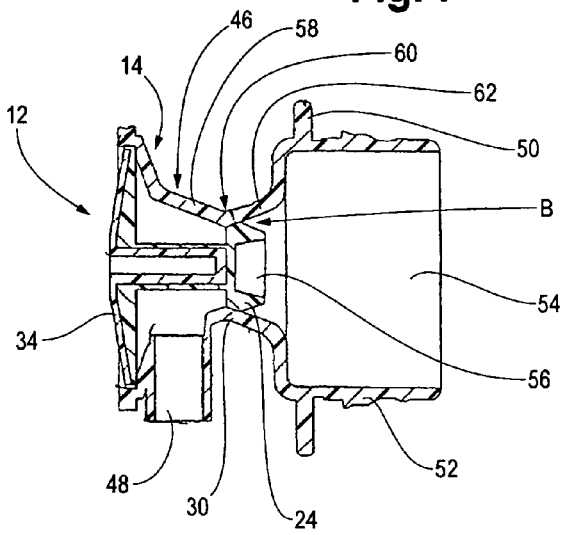
FIG. 7 is a side cross-sectional view, taken along line 7-7 of FIG. 6, of the assembled actuator and valve housing of Applicant's dispensing tap for beverages and, in particular, illustrating the dispensing tap in the closed position.

The actuator 12 is then inserted into the valve housing 14 by merely pushing the actuator 12 into the valve open top 44 of the valve housing 14, as illustrated in FIG. 7. As the actuator 12 is being inserted into the valve housing 14, the neck 46 of the valve housing 14 provides an inwardly tapering wall 58 that forces an inward pressure on the head 24 of the actuator 12. This inward pressure is increasingly applied by the inwardly tapering wall 58 up until a throat 60 in the neck 46. As this occurs, the recess 56 in the head 24 permits the sidewall 28 to sufficiently compress to allow the head 24 to continue to proceed through the inwardly tapering wall 58 and the throat 60 in the neck 46. Once the head 24 has proceeded through the throat 60, the neck 46 provides an outwardly tapering wall 62 that extends to the collar 50. The outwardly tapering wall 62 of the neck 46 releases the pressure on the head 24 of the actuator 12 allowing the sidewall 28 to decompress and/or return to its original state. When this occurs, the outward tapered surface 30 of the sidewall 28 engages the outwardly tapering wall 62 of the neck 46 to create or form a tight seal (i.e., seal B) between them and thereby also secure the actuator 12 to the valve housing 14. This engagement between the head 24 and neck 46 provides the area where the seal B can be opened and closed to allow or inhibit the flow of liquid to be dispensed from the container and out through the spout 48 of the dispensing tap 10. The resultant combination of the actuator 12 with the valve housing 14 forms the dispensing tap 10.

In the preferred embodiment, the dispensing tap 10 is utilized for liquids contained in "Bag-In-Box" applications such as, for example, boxed wine. Alternatively, the dispensing tap 10 may be used for any and all applications where liquids are dispensed from containers or any and all other applications known to those skilled in the art.

The dispensing tap 10 is preferably secured to the container, plastic bag, etc. . . . (collectively referred to herein as "container") using the circular ring 52 of the valve housing 14. In this manner, the circular ring 52 is inserted into the container that contains the liquid to be dispensed. The circular ring 52 may have threads or similar ridges so that it can be securely seated in the container. The collar 50 of the valve housing 14 forms a stop against which the container is sealed and controls the depth to which the circular ring 52 is inserted into the container. The container is sealed against the collar 50 to prevent liquid from flowing out of the container through any openings or leaks between the valve housing 14 and the container.

Figure 8:
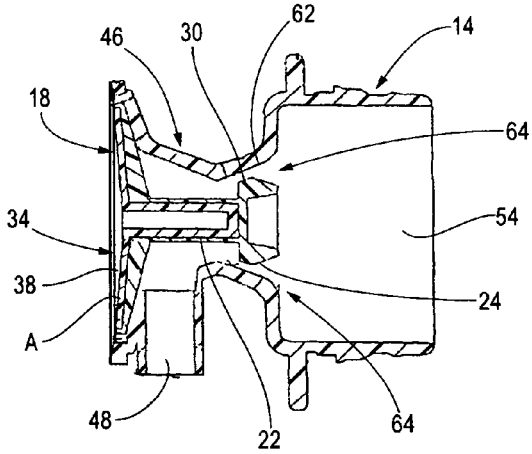
FIG. 8 is a side cross-sectional view of the assembled actuator and valve housing of Applicant's dispensing tap for beverages and, in particular, illustrating the dispensing tap in the open position.

To operate the dispensing tap 10, as illustrated in FIG. 8, the user pushes on the topside 38 of the top 34 of the conical spring washer 18 in the direction toward the valve open bottom 54 and container. The force exerted on the top 34 overcomes the resistive force of the conical spring washer 18 and pushes or moves the actuator shaft 22 in the direction toward the valve open bottom 54. As the actuator shaft 22 moves, this likewise pushes or moves the head 24 into the valve open bottom 54 of the valve housing 14. When this occurs, the outward tapered surface 30 of the sidewall 28 disengages from the outwardly tapering wall 62 of the neck 46 thereby opening seal B and creating a passageway 64 between them. Once seal B is opened and the passageway 64 created, the liquid in the container can flow through the valve open bottom 54, through the passageway 64, and then dispensed out the spout 48. In the preferred embodiment, the liquid will continue to flow in this manner as long as the force exerted on the top 34 is maintained to overcome the resistive force of the conical spring washer 18 and keeps seal B open. During this dispensing of the liquid, seal A remains tight and prevents the fluid from flowing past the conical spring washer 18 and the valve housing 14.

Once the force exerted on the top 34 is released from the conical spring washer 18, the design and material of the conical spring washer 18 causes it to return back to its original position. This pulls or causes the actuator shaft 22 to move in the direction away from the valve open bottom 54, as illustrated in FIG. 7. As the actuator shaft 22 moves, this likewise pulls and moves the head 24 in the direction away from the valve open bottom 54 of the valve housing 14. When this occurs, the outward tapered surface 30 of the sidewall 28 reengages the outwardly tapering wall 62 of the neck 46 thereby closing seal B and closing the passageway 64 between them. In this manner, the conical spring washer 18 enables the actuation within the dispensing tap 10 for it to be effectively opened and closed, as desired.

The design and material of the conical spring washer 18 provides the spring function and travel of the actuator 12. The material of the actuator base 16 assists in returning the conical spring washer 18 to the relaxed or original position when the conical spring washer 18 has been over-traveled and prevents the conical spring washer 18 from staying inverted.

As a result, Applicant's inventive dispensing tap 10 has fewer parts and is easy to assemble. The two material actuator 12 is made from a two shot molded process giving it sealing and structural properties. The dispensing tap 10 opens, closes, and shuts off like other taps that use five parts and have a more complicated actuating mechanism and assembly. Less parts results in a simplified construction, lower cost, with less parts to wear out, malfunction or fail. Thus, there has been provided Applicant's unique dispensing tap for beverages.

While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A dispensing tap for beverages, comprising:

an actuator base having a base top having an opening and an actuator shaft having a long axis with a hollow channel terminating in a head, the actuator shaft extending outwardly from the top with the opening in the base top aligned with the hollow channel in the actuator shaft, and the head having an exterior sidewall with an outward tapered surface and an inward tapered surface;

a conical spring washer having a top having a topside and an underside, and a positioning post extending outwardly from the underside of the top, the positioning post of the conical spring washer being inserted through the opening in the base top and into the hollow channel in the actuator shaft until the underside of the top engages the base top;

means for sealing the conical spring washer to the actuator shaft for forming an actuator;

a hollow valve housing having a valve open top, a neck, a spout, and a valve open bottom, the neck defining an inwardly tapering wall extending from adjacent the valve open top and terminating at a throat and an outwardly tapering wall extending outwardly from the throat and terminating adjacent the valve open bottom;

the outward tapered surface of the exterior sidewall of the head engaging the outward tapering wall of the neck to form a seal within the valve housing, the actuator moving inwardly in a straight line substantially along the long axis of the actuator shaft within the valve housing when a force is applied to the top of the conical spring washer causing the outward tapered surface to disengage from the outward tapering wall of the neck to release the seal;

a circular passageway between the outward tapered surface of the exterior sidewall of the head and the outward tapering wall of the neck;

the actuator shaft and the head moving outwardly along the long axis of the actuator shaft causing the outward tapered surface of the exterior sidewall of the head to re-engage the outwardly tapering wall of the neck to reform the seal when the force is removed from the top of the conical spring;

the positioning post when inserted into the actuator shaft imparting rigidity to the actuator shaft, the actuator shaft remaining in a substantially straight orientation without any lateral support when the actuator and head are moved inwardly and outwardly during its operation to open and close the seal;

a second seal formed between the valve open top and the base top for stopping the flow of any beverage past the base top and the conical spring washer;

wherein, the actuator and the valve housing form the dispensing tap after the actuator is inserted and secured in the valve housing.

2. The dispensing tap of claim 1 wherein, during the insertion of the actuator into the valve housing, the inwardly tapering wall of the neck applies an increasingly inward force upon the head.

3. The dispensing tap of claim 2 wherein the head has a recessed portion that permits the exterior sidewall to be compressed from the inwardly tapering wall and inserted through the throat.

4. The dispensing tap of claim 1 wherein the passageway is in fluid communication between the valve housing and the spout for permitting the beverage to flow through the valve housing and be dispensed out the spout.

5. A dispensing tap, comprising:

an actuator having a long axis and a spring loaded top and a base top situated in a resting position, an actuator member extending outwardly from the base top, and a head attached to the actuator member;

a hollow valve housing having a valve open top, a neck, a spout, and a valve open bottom;

the actuator inserted into the hollow valve housing to form the dispensing tap;

means for forming a first circular seal between the head of the actuator and the neck of the valve housing, the circular seal preventing any liquid from being dispensed through the spout when the spring loaded top is in the resting position;

the spring loaded top moving in a straight line substantially along the long axis of the actuator shaft from the resting position into an extended position when an axial force is applied to the spring loaded top;

the spring loaded top, in the extended position, actuating the actuator member and the head causing the circular seal to be released and creating a circular opening between the actuator and the valve housing wherein liquid can flow through the opening and be dispensed out the spout of the dispensing tap;

the spring loaded top automatically returning to the resting position when the axial force is released, the spring loaded top actuating the actuator member and the head to re-form the circular seal between the head of the actuator and the neck of the valve housing;

the actuator member remaining in a substantially straight orientation without any lateral support when the actuator and head are moved between the extended position to the resting position during its operation;

a second seal formed between the valve open top and the base top for stopping the past flow of any liquid the base top and spring loaded top.

6. The dispensing tap of claim 5 wherein the spring loaded top forms a convex shape when in the extended position.

7. The dispensing tap of claim 5 wherein the spring loaded top is formed from a conical spring washer integrally sealed to the base top.

8. The dispensing tap of claim 7 wherein the conical spring washer is made of a polycarbonate material.

9. The dispensing tap of claim 8 wherein the actuator base is made of a thermo plastic elastomer material.

10. A dispensing tap for beverages, comprising:

a conical spring washer providing a top having a topside and an underside, and a positioning post extending outwardly from the underside of the top;

an actuator base having a base top with an opening and an actuator shaft having a long axis with a hollow channel, the actuator shaft extending outwardly from the top with the opening in the base top aligned with the hollow channel in the actuator shaft, the positioning post of the conical spring washer inserted through the opening in the base top and into the hollow channel in the actuator shaft until the underside of the top engages the base top;

means for sealing the conical spring washer to the actuator shaft for forming an actuator member;

a hollow valve housing having a valve open top, a neck, a spout, and a valve open bottom;

a first circular seal between the head of the actuator and the neck of the valve housing, the circular seal preventing any liquid from being dispensed through the spout when the spring loaded top is in a resting position;

a second seal formed between the valve open top and the base top for stopping the flow of any liquid from the valve housing past the base top and spring loaded top, the positioning post when inserted into the actuator shaft imparting rigidity to the actuator shaft, the actuator shaft remaining in a substantially straight orientation along the long axis of the actuator shaft without any lateral support when the actuator member and head are moved inwardly and outwardly during its operation; and the actuator member inserted into the valve housing to form the dispensing tap.

11. The dispensing tap of claim 10 wherein actuating the actuator member moves from a first closed position to a second open position when an axial force is applied to the conical spring washer in relation to the valve housing to release the first seal and permit liquid to freely flow through the dispensing tap.

12. The dispensing tap of claim 11 and wherein the actuator member automatically moves in a substantially straight orientation along the long axis of the actuator shaft from the first position when the axial force is released to re-seal the actuator member to the valve housing.

* * * * *